US005680990A

United States Patent [19]

Wang

[11] Patent Number: 5,680,990

[45] Date of Patent: Oct. 28, 1997

[54] ROTARY HEAD STRUCTURE OF A LAWN SPRINKLING SEAT

[75] Inventor: King-Yuan Wang, Changhua Hsien, Taiwan

[73] Assignee: Yuan Mei Corporation, Changhua Hsien, Taiwan

[21] Appl. No.: 579,248

[22] Filed: Dec. 27, 1995

[51] Int. Cl.[6] ..... B05B 3/00; B05B 3/06; B05B 15/08

[52] U.S. Cl. ..... 239/247; 239/258; 239/264; 239/587.4

[58] Field of Search ..... 239/246, 247, 239/251, 258, 261, 264, 279, 273, 536, 556, 557, 587.4, DIG. 1

[56] References Cited

U.S. PATENT DOCUMENTS

| | | | |
|---|---|---|---|
| 2,935,265 | 5/1960 | Richter | 239/587.4 X |
| 2,983,452 | 5/1961 | Lindbloom | 239/261 X |
| 3,791,585 | 2/1974 | Warren | 239/587.4 X |
| 4,905,903 | 3/1990 | Katzer et al. | 239/246 |
| 5,307,993 | 5/1994 | Simonetti et al. | 239/247 |

*Primary Examiner*—Andres Kashnikow
*Assistant Examiner*—Robin O. Evans
*Attorney, Agent, or Firm*—Bacon & Thomas

[57] ABSTRACT

A rotary head structure of a lawn sprinkling seat, including a base seat, a sprinkling head and a T-shaped locking body. The base seat is formed with a central water-outgoing connector. The sprinkling head has three radially extending water-outgoing passages spaced by equal angle and an insertion post on bottom face for fitting into the locking body which is screwed into the water-outgoing connector of the base seat. The water is conducted from the base seat to the sprinkling head to flow out from the water-outgoing passages thereof. A free end of each water-outgoing passage is formed with a large diameter hole having a conic peripheral wall for receiving a valve post of a hollow ball valve. The valve post of the ball valve is first passed through a tapered opening of a cylindrical valve sleeve and then fitted into the large diameter hole of the water-outgoing passage and fused therewith by ultrasonic wave. The tapered opening of the valve sleeve has an inclined outer peripheral wall face and an inner peripheral wall face for snugly slidably abutting against the spherical face of the ball valve for angle adjustment thereof. The other end of the valve sleeve is screwed with a threaded neck portion of a cylindrical sprinkling sleeve formed with multiple sprinkling holes by different angles. The end of the sprinkling sleeve is formed with an inclined inner face for snugly contacting with the spherical face of the ball valve to complete the assembly.

1 Claim, 5 Drawing Sheets

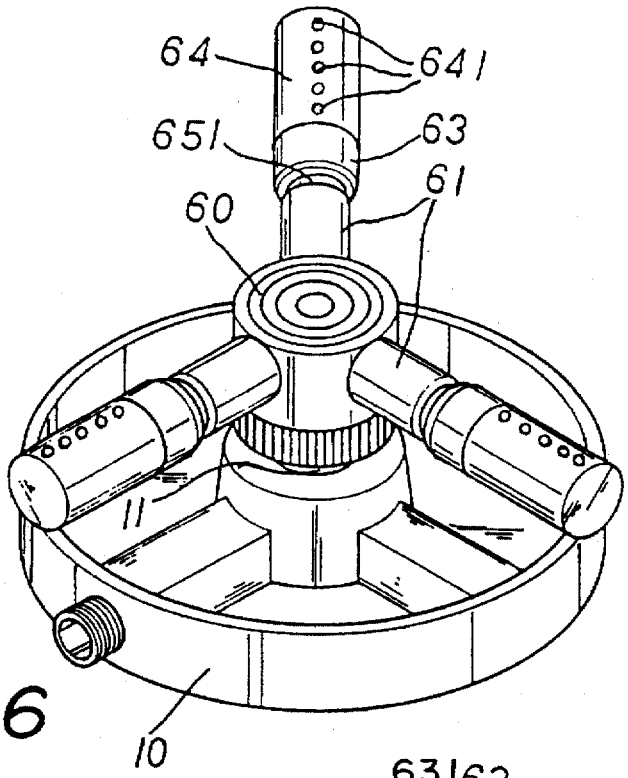
FIG. 6
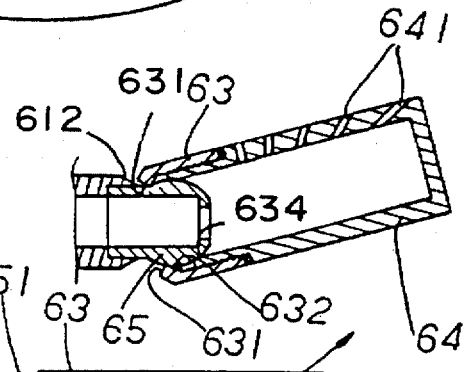
FIG. 7A
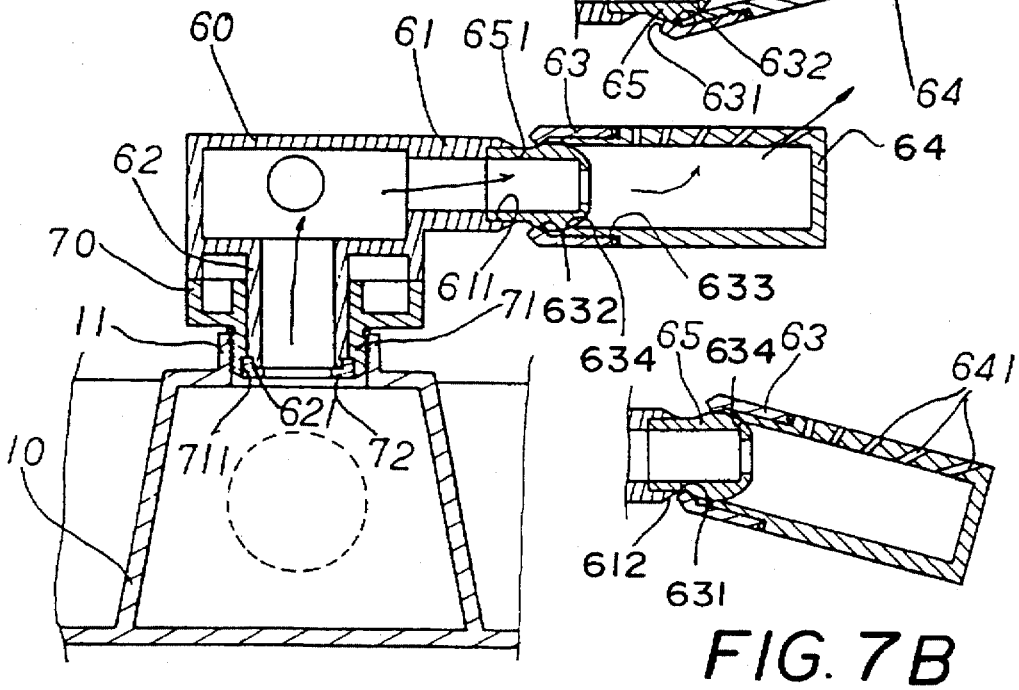
FIG. 7B
FIG. 7

ROTARY HEAD STRUCTURE OF A LAWN SPRINKLING SEAT

BACKGROUND OF THE INVENTION

The present invention relates to a rotary head structure of a lawn sprinkling seat, including a base seat, a sprinkling head and a T-shaped locking body. The base seat is formed with a central water-outgoing connector. The sprinkling head has three radially extending water-outgoing passages spaced by equal angle and an insertion post on bottom face for fitting into the locking body which is screwed into the water-outgoing connector of the base seat. Each water-outgoing passage is connected with a cylindrical sprinkling sleeve formed with multiple sprinkling holes by different angles. The three sprinkling sleeves are freely adjustable in angle so as to sprinkle the water conducted from the base seat and the sprinkling passages in various directions.

FIG. 1 shows a conventional rotary head structure of a lawn sprinkling seat, in which the sprinkling head 20 is a circular integral body, having three radially extending water-outgoing passages 21 spaced by equal angle and an insertion post 24 on bottom face for fitting into a hollow post 31 of the locking body 30. A lower end of the insertion post 24 is flush, with a lower end of the hollow post 31 of the locking body 30. A fastening pin 32 having a flange 321 is passed through a water-sealing washer 33 and a hard plastic ring 34 and then tightly fitted into the insertion post 24. The flange 321 secures the hard plastic ring 34 and the water-sealing washer 33 to the locking body 30 at the end of the insertion post 24 of the sprinkling head 20. The locking body 30 has a sleeve portion 35 having inner thread around the hollow post 31 so that the locking body 30 is screwed with the water-outgoing connector 11 of the base seat 10 and the water is conducted into the sprinkling head 20 to flow out from the water-outgoing passages 21 thereof.

Each water-outgoing passage 21 is formed with an extending small diameter portion 211 having a close end. The ends of the water-outgoing passage 21 and the small diameter portion 211 are respectively formed with a large and a small annular grooves 212, 213 in which a large and a small water-sealing washers 22, 221 are fitted. A water-outgoing opening 214 is formed on the small diameter portion 211. A water-sealing washer 216 is fitted in an annular groove 215 around the opening 214. A triangular sprinkling sleeve 23 formed with sprinkling holes 251 on three corners is fitted around the small diameter portion 211. The sprinkling sleeve 23 has a close end and an open end and a large and a small diameter holes corresponding to the water-outgoing passage 21 and the small diameter portion 211. As shown in FIG. 2, the sprinkling sleeve 23 is fitted with the water-outgoing passage 21 so that the water is conducted into the sprinkling sleeve 23 and sprinkled out from the sprinkling holes 231 thereof. The sprinkling head 20 is rotated to sprinkle the water onto the lawn in various directions. The angle of the sprinkling sleeve 23 can be adjusted to sprinkle the water from the sprinkling holes 231 of one of the three corners. However, the sprinkling sleeve 23 itself cannot be adjusted relative to the water-outgoing passage 21 so that the sprinkling pattern is monotonous.

FIG. 3 shows another conventional rotary head structure of a lawn sprinkling seat, in which the sprinkling head 40 is a circular integral body, having three radially extending water-outgoing passages 41 spaced by equal angle and an insertion post 46 on bottom face for fitting into a hollow post 51 of the locking body 50. A fastening pin 52 having a flange 521 is tightly fitted into the insertion post 46. The locking body 50 has a lower thread portion 53 so that the locking body 50 is screwed with the water-outgoing connector 11 of the base seat 10 and the water is conducted into the sprinkling head 40 to flow out from the water-outgoing passages 41 thereof.

Each water-outgoing passage 41 is formed with an extending portion having a water-outgoing slot 411. Two water-sealing washers 42 are fitted in two annular grooves 412 at two ends of the slot 411. A sprinkling sleeve 43 formed with a row of sprinkling holes 431 in different directions is fitted around the extending portion. Each water-outgoing passage 41 has two lateral wing plates 413 protruding out of an annular stopper ring by a certain length. An engaging sleeve 44 having lateral slits 441 is fitted with the ends of the lateral wing plates 413. Then the sprinkling sleeve 43 is fitted with the end of the water-outgoing passage 41 and then a restricting case 45 having an escape slot 451 is fitted around the sprinkling sleeve 43 with the sprinkling holes 431 thereof located within the escape slot 451. The restricting case 45 also has lateral wing plates 452 fitted into the lateral slits 441 of the engaging sleeve 44 and binded therewith by an adhesive to form a structure as shown in FIG. 4.

The water is conducted into the sprinkling sleeve 43 and sprinkled out from the sprinkling holes 431 thereof. The sprinkling head 40 is rotated to sprinkle the water on to the lawn in various directions. The sprinkling holes 431 of the sprinkling sleeve 43 can be adjusted in angle within the escape slot 451 of the restricting case 45. However, such adjustment is limited and the sprinkling pattern is still monotonous.

SUMMARY OF THE INVENTION

It is therefore a primary object of the present invention to provide a rotary head structure of a lawn sprinkling seat, including a base seat, a sprinkling head and a T-shaped locking body. The base seat is formed with a central water-outgoing connector. The sprinkling head has three radially extending water-outgoing passages spaced by equal angle and an insert ion post on bottom face for fitting into the locking body which is screwed into the water-outgoing connector of the base seat. Each water-outgoing passage is connected with a cylindrical sprinkling sleeve formed with multiple sprinkling holes by different angles. The angle of the sprinkling sleeve can be adjusted through 360 degrees. The inclined inner peripheral wall face of the tapered opening of the valve sleeve and the inclined inner face of the sprinkling sleeve are both slidable on the spherical face of the ball valve. The conic peripheral wall of the water-outgoing passage is substantially parallel to the end face of the tapered opening so that the sprinkling sleeve can be freely rotated. Accordingly, the three sprinkling sleeves can be freely adjusted in angle to sprinkle the water in various directions.

The present invention can be best understood through the following description and accompanying drawings, wherein:

BRIEF DESCRIPTION OF THE DRAWINGS

FIG. 6 is a perspective assembled view of the present invention;

FIG. 7 is a sectional assembled view according to FIG. 6, showing the path of the water flow; and FIGS. 7A and 7B show the angle adjustment of the sprinkling sleeve of the present invention.

DETAILED DESCRIPTION OF THE PREFERRED EMBODIMENT

Figure 1:
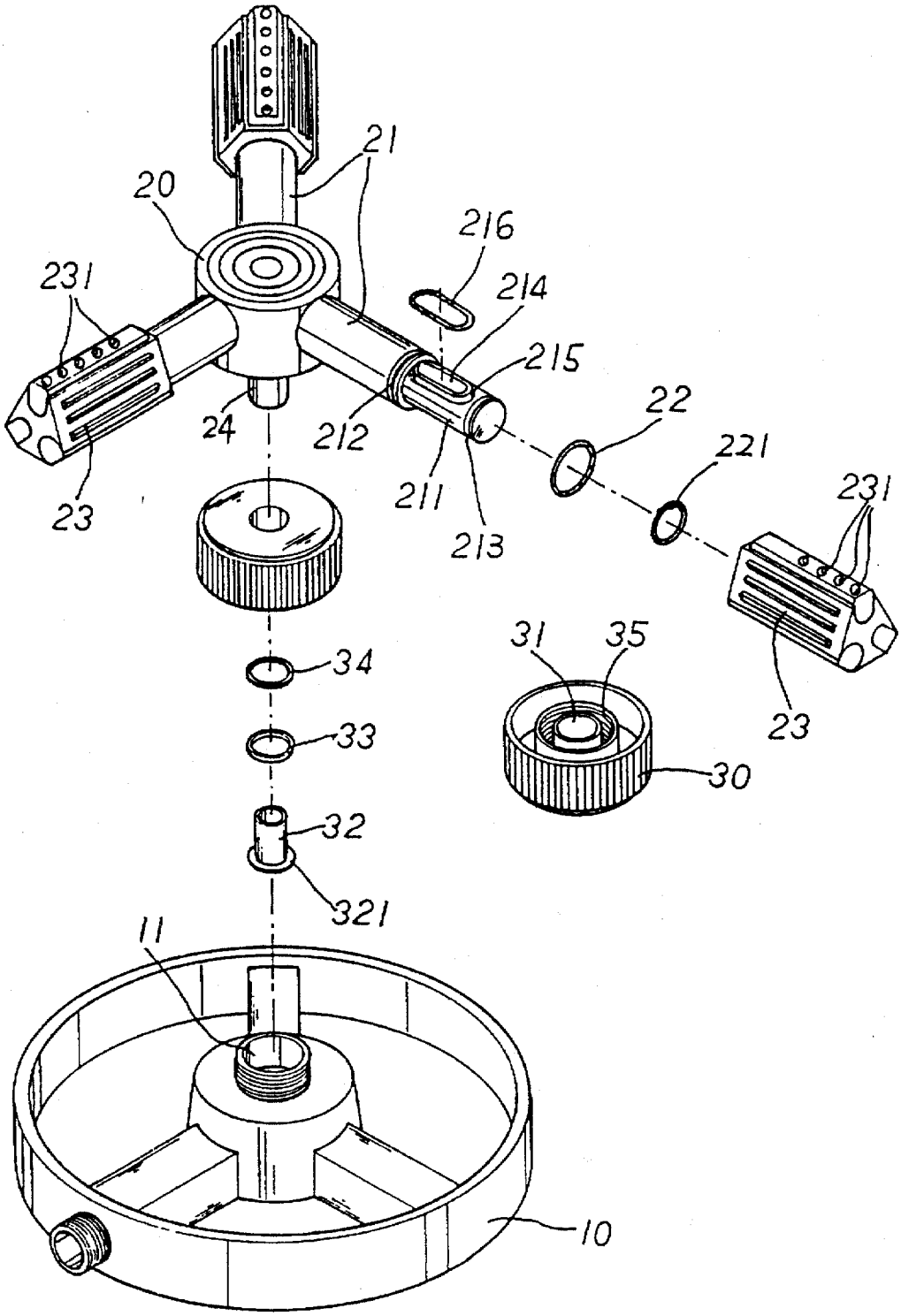
FIG. 1 PRIOR ART
FIG. 1 is a perspective exploded view of a conventional rotary head structure of a lawn sprinkling seat.
Figure 2:
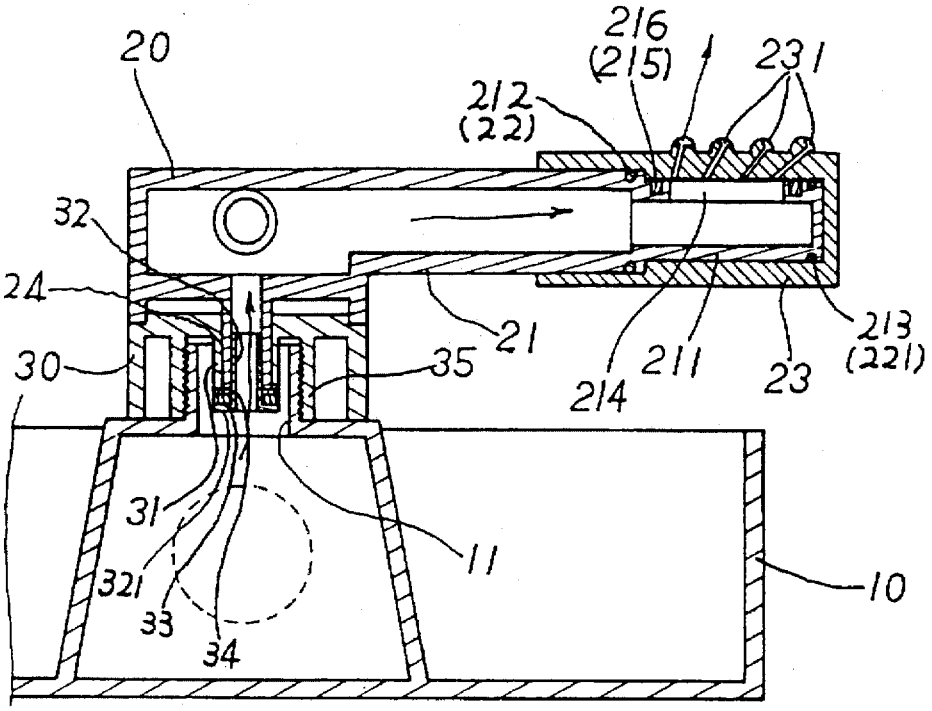
FIG. 2 PRIOR ART
FIG. 2 is a sectional assembled view according to FIG. 1.
Figure 4:
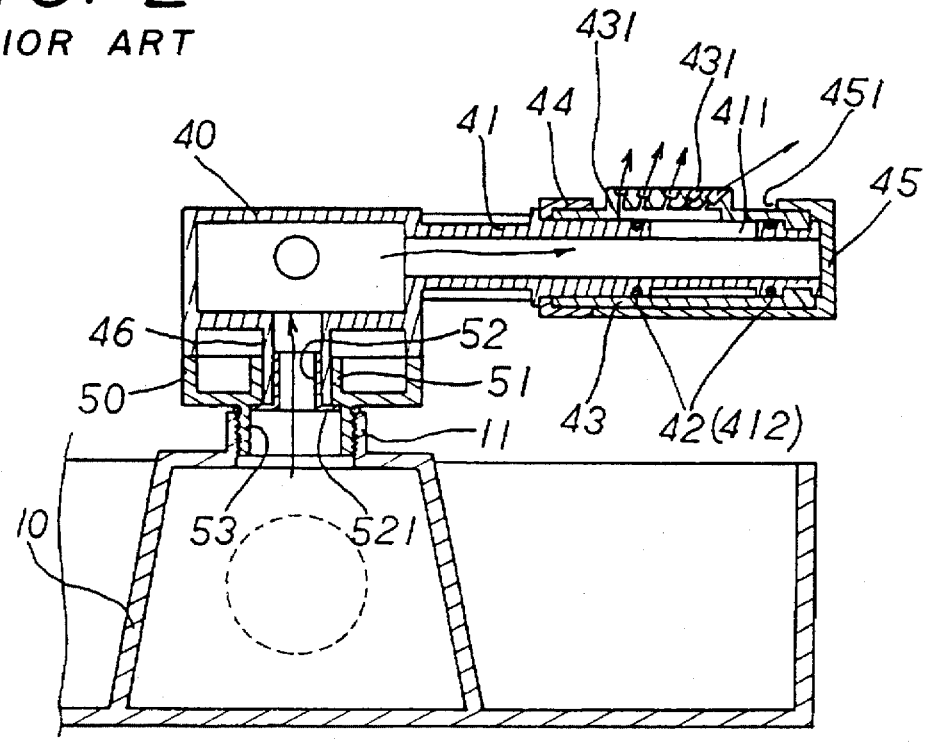
FIG. 4 PRIOR ART
FIG. 4 is a sectional assembled view according to FIG. 3.
Figure 3:
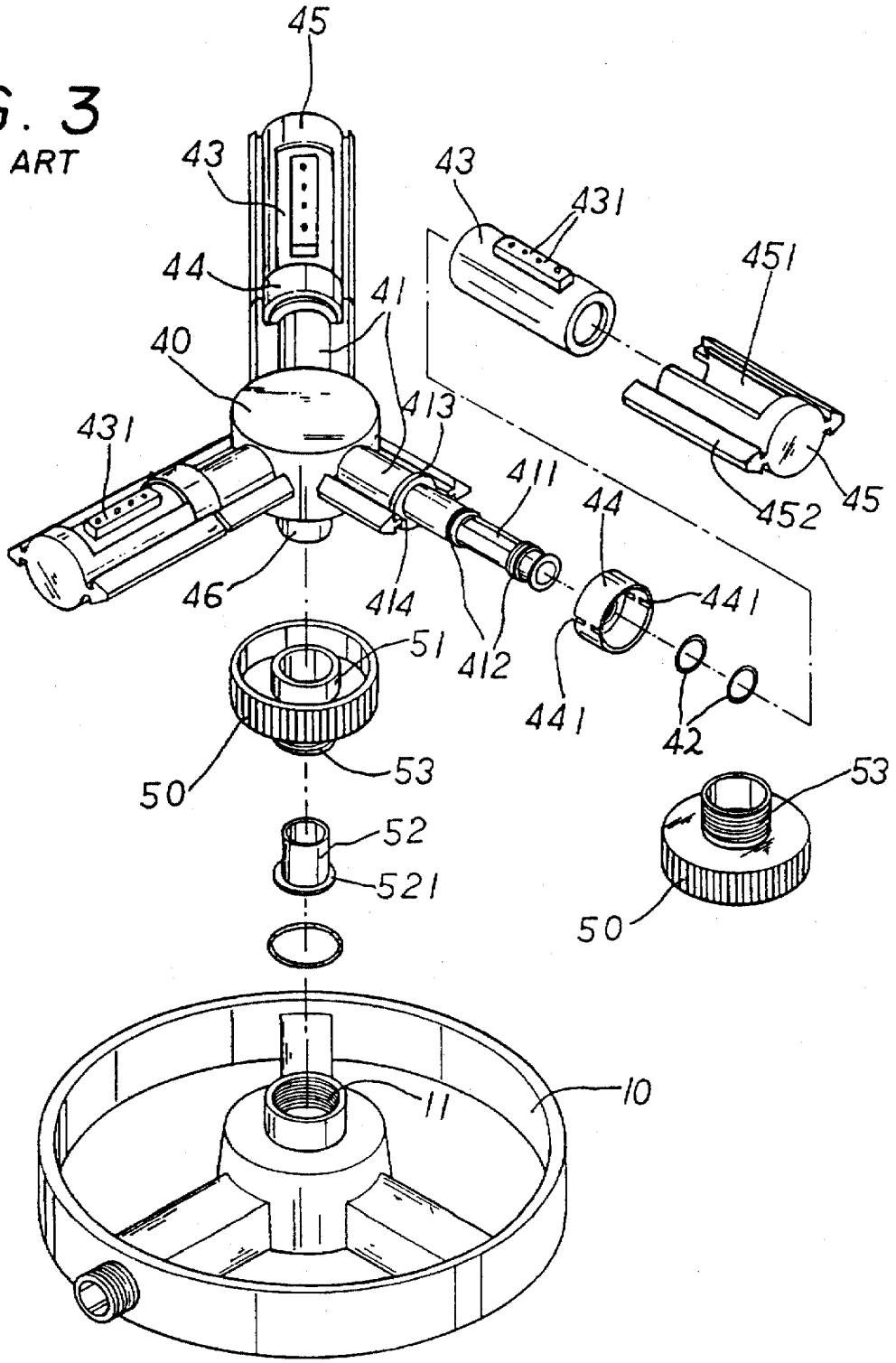
FIG. 3 PRIOR ART
FIG. 3 is a perspective exploded view of another conventional rotary head structure of a lawn sprinkling seat.
Figure 5:
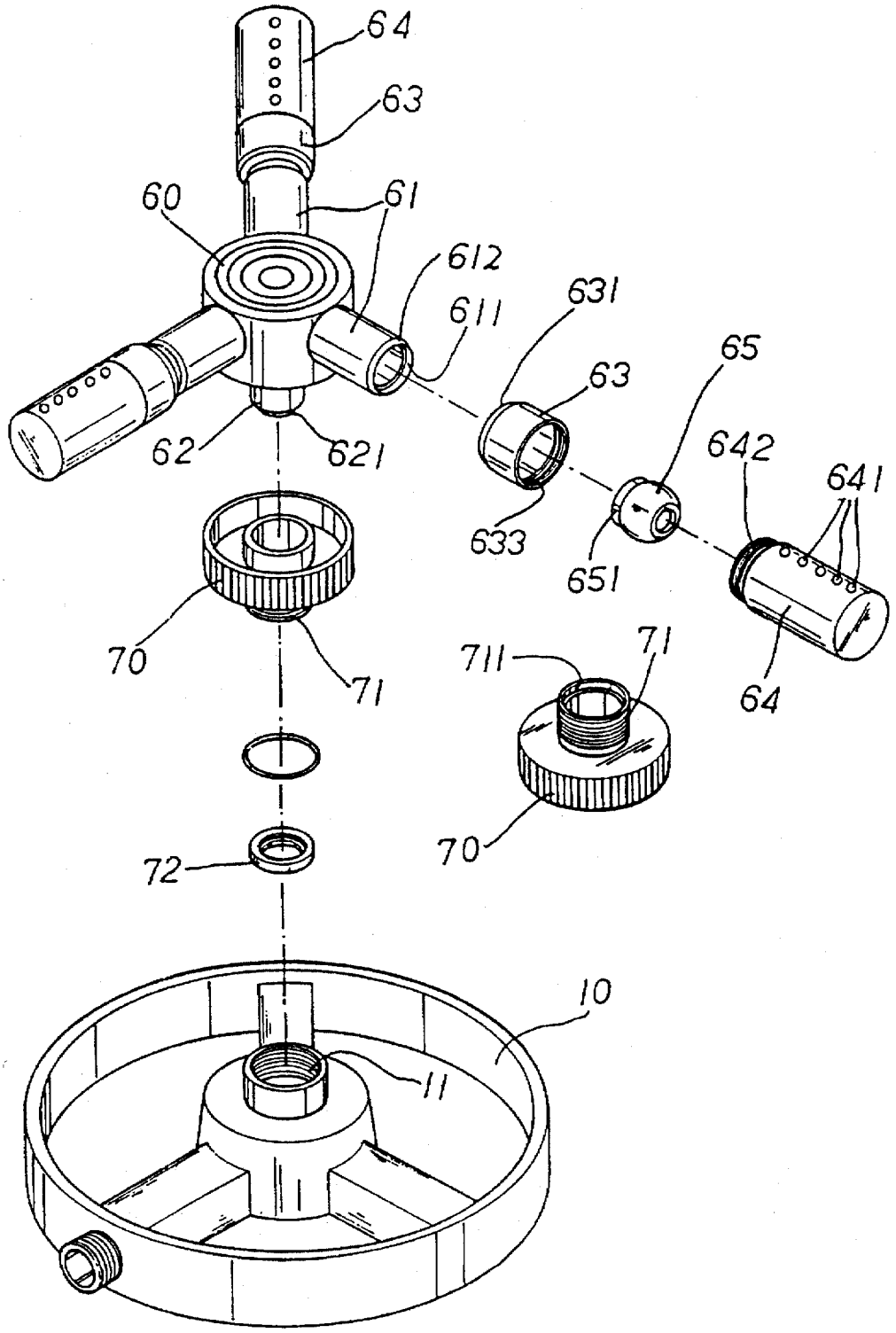
FIG. 5 is a perspective exploded view of the present invention.

Please refer to FIG. 5. The present invention includes a base seat 10, a sprinkling head 60 and a T-shaped locking body 70. The base seat 10 is formed with a central water-outgoing connector 11 having inner thread. The sprinkling head 60 is a circular integral body, having three radially extending water-outgoing passages 61 spaced by equal angle and an insertion post 62 on bottom face for fitting into the locking body 70. A lower end of the insertion post 62 is flush with a lower end of a lower thread portion 71 of the locking body 70. The lower end of the insertion post 62 is formed with a small diameter portion 621 and the lower end of the thread portion 71 of the locking body 70 is formed with a large diameter portion 711, whereby an annular space is defined between the small diameter portion 621 and the large diameter portion 711 for receiving a fusible ring 72. The fusible ring 72 is fused by ultrasonic wave to associate with the small diameter portion 621 of the insertion post 62 so as to bind the insertion post 62 with the locking body 70. (The fusible ring 72 is not fused with the lower end of the locking body 70.) The thread portion 71 of the locking body 70 is screwed into the central water-outgoing connector 11 of the base seat 10 so that the water is conducted into the sprinkling head 60 to flow out from the water-outgoing passages 61 thereof.

A free end of each water-outgoing passage 61 is formed with a large diameter hole 611 having a conic peripheral wall 612 for receiving a valve post 651 of a hollow ball valve 65. The valve post 651 of the ball valve 65 is first passed through a tapered opening 631 of a cylindrical valve sleeve 63 and then fitted into the large diameter hole 611 of the water-outgoing passage 61 and fused therewith by ultrasonic wave. The tapered opening 631 of the valve sleeve 63 has an inclined inner peripheral wall face 632 for snugly slidably abutting against the spherical face of the ball valve 65 in order to adjust the angle thereof. The tapered opening 631 also has an inclined outer peripheral wall face. The valve sleeve 63 has an open end opposite to the tapered opening, having an inner thread portion 633 to be screwed with a threaded neck portion 642 at one end of a cylindrical sprinkling sleeve 64 formed with multiple sprinkling holes 641 by different angles. The end of the sprinkling sleeve 64 is formed with an inclined inner face 643 for snugly contacting with the spherical face of the ball valve 65 to complete the assembly as shown in FIG. 6.

Please refer to FIGS. 7 to 7B. The water is conducted through the water-outgoing connector 11 of the base seat 10, the water-outgoing passages 61 of the sprinkling head 60, the ball valves 65 and the valve sleeves 63 and then sprinkled out from the sprinkling holes 641 of the sprinkling sleeves 64. At this time, the sprinkling head 60 is rotated to sprinkle the water onto the lawn in various directions. In addition, the angle of the sprinkling sleeve 64 can be adjusted through 360 degrees. Moreover, the inclined inner peripheral wall face 632 of the tapered opening 631 of the valve sleeve 63 and the inclined inner face 643 of the sprinkling sleeve 64 are both slidable on the spherical face of the ball valve 65. The conic peripheral wall 612 of the water-outgoing passage 61 is substantially parallel to the end face of the tapered opening 631 so that the sprinkling sleeve 64 can be freely rotated. Accordingly, the three sprinkling sleeves can be freely adjusted in angle to sprinkle the water in various directions.

The above description and drawings are only used to illustrate one embodiment of the present invention and the scope of the present invention should not be limited to the embodiment. Any modification or variation derived from the embodiment should fall within the scope of the present invention.

What is claimed is:

1. A rotary head structure of a lawn sprinkling seat, comprising a base seat, a sprinkling head and a T-shaped locking body, the base seat being formed with a central water-outgoing connector having inner thread, said rotary head structure being characterized in that:

the sprinkling head is a circular integral body, having three radially extending water-outgoing passages spaced by equal angle and an insertion post on bottom face for fitting into the locking body, a lower end of the insertion post being flush with a lower end of a lower thread portion of the locking body, the lower end of the insertion post being formed with a small diameter portion and the lower end of the thread portion of the locking body being formed with a large diameter portion, whereby an annular space is defined between the small diameter portion and the large diameter portion for receiving a fusible ring, the fusible ring being fused by ultrasonic wave to associate with the small diameter portion of the insertion post so as to bind the insertion post with the locking body, the fusible ring being not fused with the lower end of the locking body, the thread portion of the locking body being screwed into the central water-outgoing connector of the base seat so that the water is conducted into the sprinkling head to flow out from the water-outgoing passages thereof; and a free end of each water-outgoing passage is formed with a large diameter hole having a conic peripheral wall for receiving a valve post of a hollow ball valve, the valve post of the ball valve being first passed through a tapered opening of a cylindrical valve sleeve and then fitted into the large diameter hole of the water-outgoing passage and fused therewith by ultrasonic wave, the tapered opening of the valve sleeve having an inclined inner peripheral wall face for snugly slidably abutting against the spherical face of the ball valve in order to adjust the angle thereof, the tapered opening also having an inclined outer peripheral wall face, the valve sleeve having an open end opposite to the tapered opening, having an inner thread portion to be screwed with a threaded neck portion at one end of a cylindrical sprinkling sleeve formed with multiple sprinkling holes by different angles, the end of the sprinkling sleeve being formed with an inclined inner face for snugly contacting with the spherical face of the ball valve to complete the assembly, whereby the water is conducted through the water-outgoing connector of the base seat, the water-outgoing passages of the sprinkling head, the ball valves and the valve sleeves and then sprinkled out from the sprinkling holes of the sprinkling sleeves and the sprinkling head is rotated to sprinkle the water onto the lawn in various directions, the angle of the sprinkling sleeve being adjustable through 360 degrees, the inclined inner peripheral wall face of the tapered opening of the valve sleeve and the inclined inner face of the sprinkling sleeve being both slidable on the spherical face of the ball valve, the conic peripheral wall of the water-outgoing passage being substantially parallel to the end face of the tapered opening so that the sprinkling sleeve can be freely rotated, the three sprinkling sleeves being freely adjustable in angle to sprinkle the water in various directions.

* * * * *